US009162443B2

(12) United States Patent
Ieiri

(10) Patent No.: US 9,162,443 B2
(45) Date of Patent: Oct. 20, 2015

(54) INK JET RECORDING DEVICE AND SHORT CIRCUIT PROTECTION METHOD FOR INK JET RECORDING DEVICE

(71) Applicant: Yuji Ieiri, Kanagawa (JP)

(72) Inventor: Yuji Ieiri, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/561,412

(22) Filed: Dec. 5, 2014

(65) Prior Publication Data

US 2015/0174896 A1 Jun. 25, 2015

(30) Foreign Application Priority Data

Dec. 24, 2013 (JP) ..... 2013-266087

(51) Int. Cl.
*B41J 29/38* (2006.01)
*B41J 2/045* (2006.01)

(52) U.S. Cl.
CPC ..... *B41J 2/04541* (2013.01)

(58) Field of Classification Search
USPC ..... 347/5, 9, 12, 10, 15, 19
See application file for complete search history.

(56) References Cited

U.S. PATENT DOCUMENTS

| | | | | |
|---|---|---|---|---|
| 5,736,997 | A | 4/1998 | Bolash et al. | |
| 6,454,377 | B1 * | 9/2002 | Ishizaki | 347/15 |
| 6,520,615 | B1 * | 2/2003 | Beck et al. | 347/19 |
| 2010/0079553 | A1 | 4/2010 | Katoh | |

FOREIGN PATENT DOCUMENTS

| | | |
|---|---|---|
| JP | 10-128965 | 5/1998 |
| JP | 2010-183805 | 8/2010 |
| JP | 5159540 | 12/2012 |

* cited by examiner

*Primary Examiner* — Lam Nguyen
(74) *Attorney, Agent, or Firm* — Cooper & Dunham LLP

(57) ABSTRACT

An ink jet recording device comprises: an ink jet recording head for discharging an ink droplet; and a recording control part for outputting a drive signal to cause the ink jet recording head to discharge an ink droplet, wherein the recording control part includes a current amplifier circuit for amplifying a drive signal by active elements connected in multi-stages, and the current amplifier circuit includes a current interruption element connected to an input side of the active element of the current amplifier circuit on a power source side, the current interruption element being for preventing damage of the active element due to an overcurrent from occurring when a short circuit of the drive signal is generated.

4 Claims, 5 Drawing Sheets

INK JET RECORDING DEVICE AND SHORT CIRCUIT PROTECTION METHOD FOR INK JET RECORDING DEVICE

CROSS-REFERENCE TO RELATED APPLICATIONS

The present application claims priority to and incorporates by reference the entire contents of Japanese Patent Application No. 2013-266087 filed in Japan on Dec. 24, 2013.

BACKGROUND OF THE INVENTION

1. Field of the Invention

The present invention relates to an ink jet recording device and a short circuit protection method for an ink jet recording device.

2. Description of the Related Art

Ink jet recording devices are being used in various applications as image forming devices such as copiers, printers, and fax machines. In an ink jet recording device, a recording operation is performed by discharging minute ink droplets onto a recording medium from an ink jet recording head corresponding to each color ink. In the discharge operation of ink droplets, a drive signal is inputted to a drive element such as a piezoelectric element provided in an ink flow path communicated with a discharge port so as to cause a pressure fluctuation in the ink inside the ink flow path and thereby cause the ink to be discharged from the discharge port, for example.

When a high-definition color image is formed, an ink jet recording head having a large number of densely-arranged discharge ports is used. In such an ink jet recording head, a large number of drive elements are densely arranged so as to correspond to the respective discharge ports. Head drive circuits are densely provided to the respective drive elements via wiring.

When an electric short circuit is generated in the head drive circuit, an overcurrent is applied thereto, thereby damaging the circuit or a component thereof. Thus, the head drive circuit is provided with a protection circuit for preventing such a trouble.

For example, Japanese Laid-open Patent Publication No. 10-128965 (1998-128965) describes an ink jet printer that detects impedances of a data line and an address line associated with a nozzle and interrupts the data line or the address line in order to prevent the damage of a driver circuit in the thermal ink jet printer.

Japanese Laid-open Patent Publication No. 2010-76312 describes a liquid discharge head drive circuit that monitors a current applied to a common line and restricts a common current when the common current which increases along with a reduction in an insulation resistance of a piezoelectric element exceeds a reference value in order to protect the liquid discharge head drive circuit, etc.

The ink jet printer described in Japanese Laid-open Patent Publication No. 10-128965 (1998-28965) and the liquid discharge had drive circuit, etc. described in Japanese Laid-open Patent Publication No 2010-76312 are each provided with a circuit for protecting the head drive circuit of the ink jet recording e. However, there is a risk that the waveform of a drive signal may be changed due to the application of a drive current to the protection circuit and this is undesirable in performing the drive control of the drive element. Moreover, regarding a circuit component used in the protection circuit, there is a problem such as increasing in size and cost of the protection circuit as a result of the use of a large-size component and an expensive component.

In view of such problems in conventional techniques, there is a need to configure a current interruption element for protecting a current amplifier circuit from a short circuit of a drive signal by employing a small and inexpensive circuit component in an ink jet recording device.

SUMMARY OF THE INVENTION

It is an object of the present invention to at least partially solve the problems in the conventional technology.

According to the present invention, there is provided an ink jet recording device comprising: an ink jet recording head for discharging an ink droplet; and a recording control part for outputting a drive signal to cause the ink jet recording head to discharge an ink droplet, wherein the recording control part includes a current amplifier circuit for amplifying a drive signal by active elements connected in multi-stages, and the current amplifier circuit includes a current interruption element connected to an input side of the active element of the current amplifier circuit on a power source side, the current interruption element being for preventing damage of the active element due to an overcurrent from occurring when a short circuit of the drive signal is generated.

The present invention also provides a short circuit protection method for protecting an ink jet recording device for outputting a drive signal to an ink jet recording head so as to perform a recording operation by discharging an ink droplet from the ink jet recording head, from a short circuit of the drive signal, the method comprising: when the short circuit of the drive signal is generated in a current amplifier circuit for amplifying the drive signal by active elements connected in multi-stages, interrupting, by means of a current interruption element connected to an input side of the active element of the current amplifier circuit on a power source side, a current applied to the active element so as to prevent damage of the active element due to an overcurrent from occurring.

The above and other objects, features, advantages and technical and industrial significance of this invention will be better understood by reading the following detailed description of presently preferred embodiments of the invention, when considered in connection with accompanying drawings.

DETAILED DESCRIPTION OF THE PREFERRED EMBODIMENTS

Figure 1:
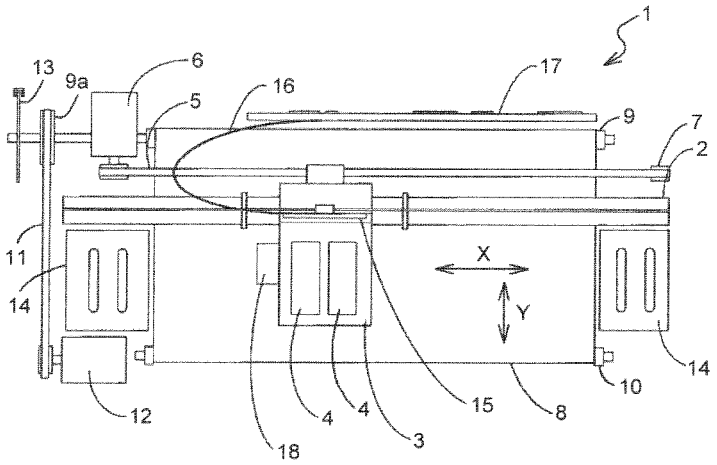
FIG. 1 is a general configuration diagram illustrating an ink jet recording device according to a present embodiment of the present invention.

FIG. 1 is a general configuration diagram illustrating an ink jet recording device according to an embodiment of the present invention. An ink jet recording device 1 includes a carriage 3 slidably attached to a guide rod 2 disposed along a main-scanning direction X. The carriage 3 is equipped with a plurality of ink jet recording heads 4. Inks corresponding to colors of yellow, cyan, magenta, and black, for example, are supplied to the ink jet recording heads 4 from an ink supply device (not shown) and the ink jet recording heads 4 discharge ink droplets from discharge ports corresponding to the inks of respective colors. A drive element such as a piezoelectric element is attached to each of ink flow paths communicated with the discharge ports. The drive element is controlled so as to cause a pressure fluctuation in the ink inside the ink flow path and thereby cause the ink to be discharged from the discharge port.

The carriage 3 is fixed to an endless timing belt 5. The timing belt 5 is disposed along the main-scanning direction X while being stretched between a driving roller and a driven roller 7 of a main scanning motor 6. The rotary drive of the main scanning motor 6 causes the carriage 3 to move in the main-scanning direction X via the timing belt 5. The discharge ports of the plurality of ink jet recording heads 4 are arranged so as to be shifted from one another in a sub-scanning direction Y. By discharging in droplets in synchronization with the movement timing of the carriage 3 in the main-scanning direction X, the discharge ports perform a recording operation along the main-scanning direction X in an area of a predetermined in the sub-scanning direct n Y. An encoder sensor is disposed inside the carriage 3. The encoder sensor detects a position in the main-scanning direction X by continuously reading an encoder sheet bridged in the main-scanning direction X so as to perform the movement control of the carriage 3.

An endless conveyance belt 8 is disposed so as to face the discharge ports of the ink jet recording heads. The conveyance belt 8 is stretched between a driving roller 9 and a driven roller 10. The conveyance belt 8 is configured so that a recording medium is placed on a conveying surface facing the ink jet recording heads and intermittently conveyed in the sub-scanning direction Y.

A drive pulley 9*a* is fixed to a drive shaft of the driving roller 9. The drive pulley 9*a* is driven by a driving roller of a sub-scanning motor 12 via a transmission belt 11. Thus, the rotary drive of the sub-scanning motor 12 causes the drive pulley 9*a* to rotate together with the driving roller 9 via the transmission belt 11 and thereby causes the conveyance belt 8 to move rotationally. As a result, the recording medium on the conveying surface is moved in the sub-scanning direction Y. A sub-scanning encoder 13 is attached to the drive shaft of the driving roller 9. A rotary operation of the driving roller 9 is detected by the sub-scanning encoder 13 so as to perform the conveyance control of the conveyance belt 8 in the sub-scanning direction Y.

In order to perform a recording operation on the recording medium, ink droplets are discharged according to image data to be recorded while moving the ink jet recording head 4 along the main-scanning direction X by means of the drive control of the main scanning motor 6. Head protection mechanisms 14 each including a suction cap or the like are disposed at standby positions on both the sides of the conveyance belt 8. When the ink jet recording heads 4 do not perform a recording operation, the ink jet recording heads 4 are moved to the standby position and brought into contact with the suction cap so that the discharge ports thereof are covered therewith. In this manner, clogging due to evaporation of moisture in the ink near the discharge ports can be prevented from occurring. Moreover, when an ink droplet is not being discharged from the discharge port in a normal manner, a discharge restoration operation is performed by sucking the ink in from the discharge port.

The carriage 3 is also equipped with a relay board 15. The relay board 15 is connected to a controller board 17 via a flexible cable 16. A drive signal regarding image data processed in the controller board 17 is transmitted to the drive element of the ink jet recording head 4 via the flexible cable 16 and the relay board 15.

The carriage 3 is also equipped with a recording medium detection sensor 18. The recording medium detection sensor 18 detects the end of a recording medium so as to control start timing of a recording operation.

An image with a predetermined width is formed on a recording medium in the main-scanning direction X by the ink jet recording head 4. Thereafter, the drive control of the sub-scanning motor 12 causes the conveyance belt 8 to perform a conveyance operation, thereby intermittently conveying the recording medium by a predetermined width in the sub-scanning direction Y. Then, a subsequent recording operation with the predetermined width is performed by the ink jet recording head 4 following the previously-recorded image. In this manner, the recording operation in the main-scanning direction X and the conveyance operation of the recording medium in the sub-scanning direction Y are alternately repeated so as to form a desired entire image on the recording medium.

Figure 2:
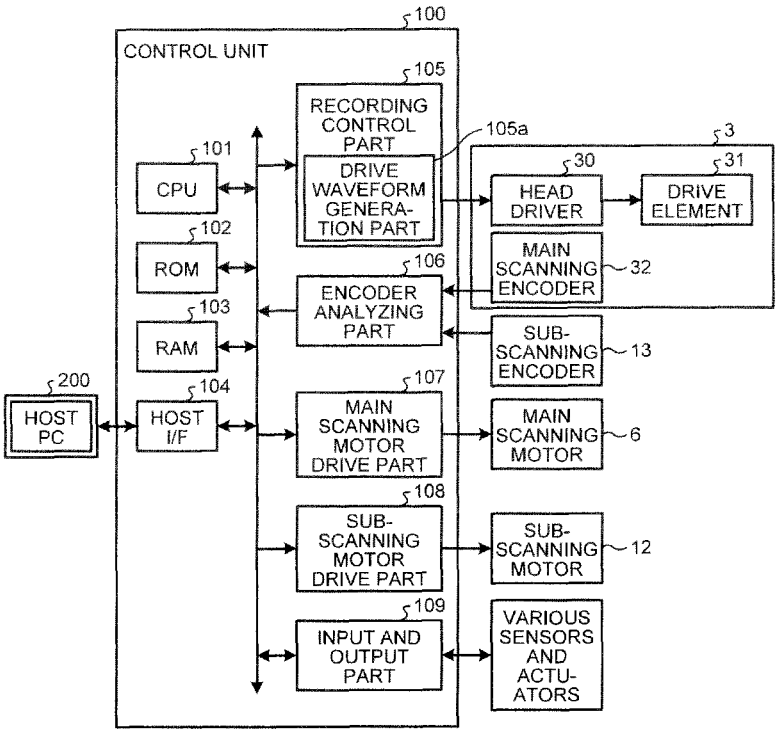
FIG. 2 is a control block configuration diagram regarding image forming processing of the ink jet recording device.

FIG. 2 is a control block configuration diagram regarding image forming processing of the ink jet recording device.

A control unit 100 is configured by a CPU (Central Processing Unit) and the like. The control unit 100 controls various components of the ink jet recording device so as to execute a predetermined operation on the basis of a basic program necessary for the ink jet recording device to be operated. A CPU 101 reads out the basic program and performs information processing necessary for the control. A ROM (Read Only Memory) 102 stores the basic program necessary for the ink jet recording device to be operated. A RAM (Random Access Memory) 103 stores information such as data necessary for control processing. A host I/F (Interface) 104 transmits to and receives from an external host PC (Personal Computer) 200. The host I/F 104 receives image data to be recorded.

A recording control part 105 generates data necessary for the recording operation on the basis of the received image data. The recording control part 105 transmits a drive signal to a head driver 30 for driving the ink jet recording head 4. The recording control part 105 includes a drive waveform generation part 105*a*. The drive waveform generation part 105*a* generates a drive waveform as a signal to be outputted to the head driver 30.

The head driver 30 drives a drive element 31 on the basis of the inputted drive waveform so as to perform a discharge operation of ink droplets. Such a drive waveform is set depending on recording conditions such as a recording mode for example, a speed prioritized mode and an image quality prioritized mode), a type of recording medium for example, plain paper and glossy paper), and the Like. The drive waveform to be set is selected on the basis of the recording conditions from among various kinds of drive waveform data stored in the ROM 102. Then, a drive waveform is generated on the basis of the selected drive waveform data in the drive waveform generation part 105*a*.

An encoder analyzing part 106 analyzes a recording position on the basis of detection signals from a main scanning encoder 32 and the sub-scanning encoder 13 provided to the carriage 3.

A main scanning motor drive part 107 performs the drive control of the main scanning motor 6 so as to move the carriage 3. The main scanning motor drive part 107 thereby performs the setting of a recording position and a standby position in the main-scanning direction, etc.

A sub-scanning motor drive part 108 performs the drive control of the sub-scanning motor 12 so as to cause the conveyance belt 8 to perform a conveyance operation. The sub-scanning motor drive part 108 thereby performs the setting of a recording position in the sub-scanning direction, etc.

An input and output part 109 is connected to various sensors and actuators provided in the device and performs input and output processing of necessary data.

Figure 3:
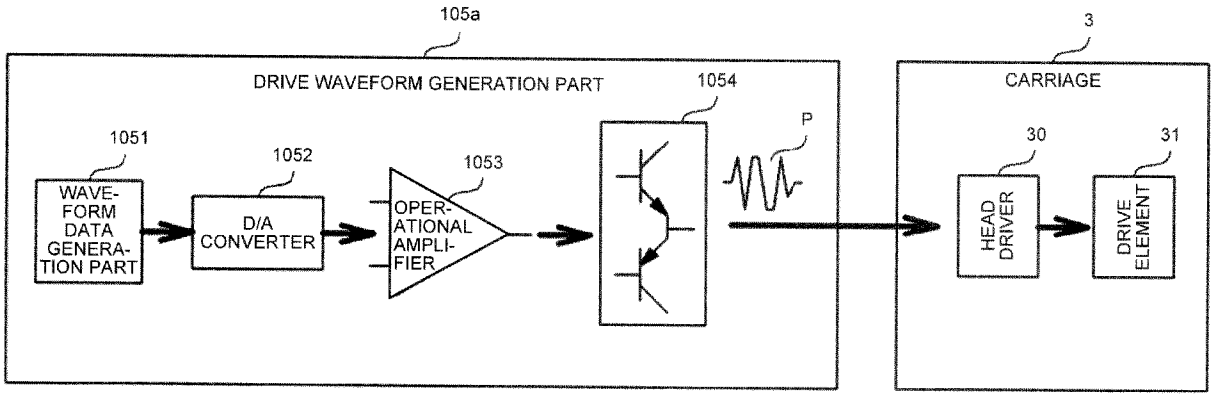
FIG. 3 is a circuit block configuration diagram regarding a drive waveform generation part.

FIG. 3 is a circuit block configuration diagram regarding the drive waveform generation part 105*a*. The drive waveform generation part 105*a* includes a waveform data generation part 1051 and a D/A (Digital/Analog) converter 1052. The waveform data generated in the waveform data generation part 1051 is converted into an analog voltage waveform by the D/A converter 1052 and voltage-amplified by en operational amplifier 1053. The voltage-amplified waveform is current-amplified by a current amplifier circuit 1054 and outputted as a drive waveform P. The drive waveform P is outputted to the head driver 30, thereby driving the drive element 31.

Figure 4A:
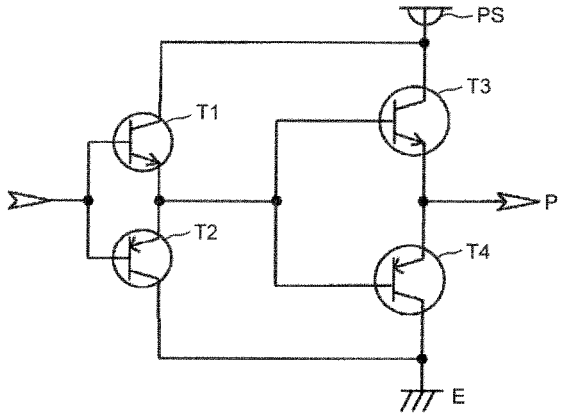
FIGS. 4A and 4B show circuit diagrams each illustrating a circuit example of a current amplifier circuit.
Figure 4B:
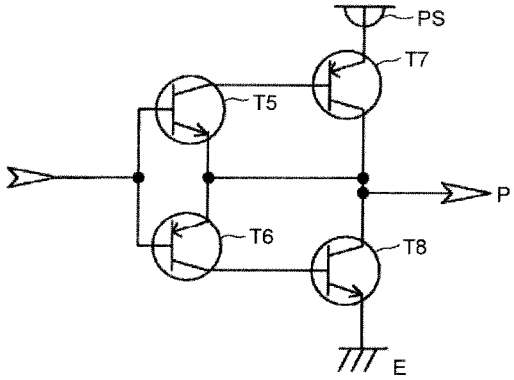

FIGS. 4A and 4B show circuit diagrams each illustrating a circuit example of the current amplifier circuit 1054. These circuit examples are configured by connecting active elements (here, typical bipolar transistors) by means of a multi-stage Darlington connection method. By employing a class B amplification method of two or more stages, the current gain of the circuit can be improved.

FIG. 4A is a circuit example regarding a normal type Darlington connection method. FIG. 4B is a circuit example regarding an inverted type Darlington connection method.

In the circuit of FIG. 4A, an NPN type transistor T1 and a PNP type transistor T2 are disposed in parallel in an input-side preceding stage. Base terminals of these transistors are connected to the input side and emitter terminals thereof are connected to each other. Also in an output-side subsequent stage, an NPN type transistor T3 and a PNP type transistor T4 are disposed in parallel as in the preceding stage. Base terminals of these transistors are connected to the emitter terminals of the transistors T1 and T2 in the preceding stage and emitter terminals thereof are connected to the output side. Collector terminals of the NPN type transistors T1 and T3 in the preceding stage and the subsequent stage are connected to a power source PS side. Collector terminals of the PNP type transistors T2 and T4 in the preceding stage and the subsequent stage are connected to a ground F side.

In the circuit of FIG. 4B, an NPN type transistor T5 and a PNP type transistor T6 are disposed in parallel in an input-side preceding stage. Base terminals of these transistors are connected to the input side and emitter terminals thereof are connected to each other. In an output-side subsequent stage, an NPN type transistor T8 and a PNP type transistor T7 are disposed in parallel in a manner opposite to that of the preceding stage. A collector terminal of the NPN type transistor T5 in the preceding stage is connected to a base terminal of the PNP type transistor T7 in the subsequent stage and a collector terminal of the PNP type transistor TB in the preceding stage is connected to a base terminal of the NPN type transistor T8 in the subsequent stage. Collector terminals of the transistors T7 and TB in the subsequent stage are connected to each other and to the emitter terminals of the transistors T5 and T1 in the preceding stage as well as to the output side. An emitter terminal of the PNP type transistor T7 in the subsequent stage is connected to a power source PS side. An emitter terminal of the NPN type transistor T8 in the subsequent stage is connected to a ground E side.

According to the ink jet recording device having the thus described configuration, when the carriage 3 is moved to perform a recording operation, a short circuit may occur between adjacent signal lines if the flexible cable 16 for transmitting a drive signal to the drive element 31 is mistakenly connected. If the signal line is grounded mistakenly due to such a signal line short circuit, an overcurrent is applied to the power source PS side transistor in the current amplifier circuit 1054, result in damage in the transistor. If the damage of the transistor the entire controller board 17 needs to be replaced and repaired, thereby resulting in an expensive repair cost.

Figure 5:
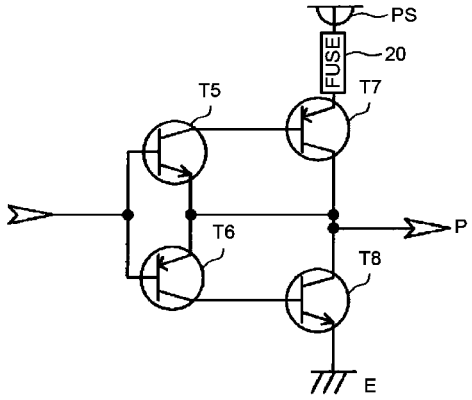
FIG. 5 is a circuit configuration diagram of a current amplifier circuit including a conventional protection circuit.

In order to prevent the damage of the power source PS side transistor due to the overcurrent applied thereto, it has been known that a protection element 20 such as a fuse (FUSE) is connected to the power source PS side as a protection circuit as shown in FIG. 5.

In the case of such a protection element 20, however, if disconnection occurs once, either the protection element 20 or the entire circuit board needs to be replaced, thereby incurring repair work and cost. Moreover, since a pulsing current with its peak at about 20 A is repeatedly applied to the current amplifier circuit 1054, the protection element 20 capable of withstanding such a pulsing current needs to be selected. Thus, the protection element 20 which is expensive and large in size needs to be employed. As the protection element 20, the use of a repeatedly usable protection element 20 such as a poly switch can be considered in place of the fuse. However, such a protection element 20 has a problem on the issue of using an expensive and large-size component.

Figure 6:
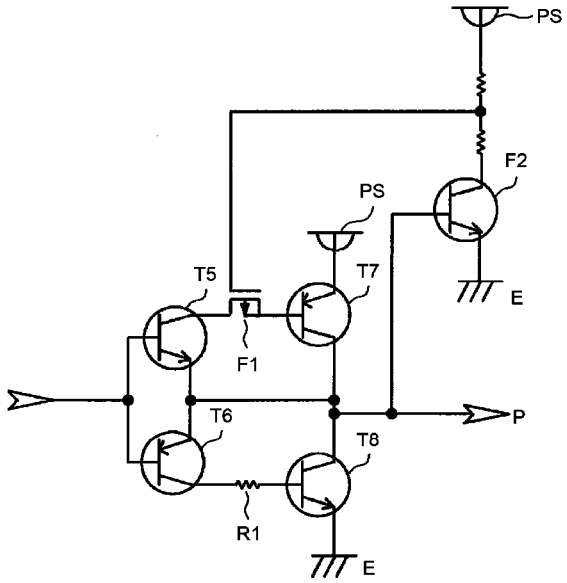
FIG. 6 is a circuit configuration diagram of a current amplifier circuit including a protection circuit used in the present embodiment.

FIG. 6 is a circuit configuration diagram of a current amplifier circuit including a protection circuit used in the present embodiment.

In the present embodiment, as a protection circuit, a field-effect transistor F1 as a current interruption element is connected to an input side of the power source PS side transistor T7 in the current amplifier circuit 1054 having the above-described circuit configuration of FIG. 4B. A P-channel field-effect transistor, for example, can be employed as such a field-effect transistor. In the present embodiment, between the collector terminal of the NPN type transistor T5 in the preceding stage and the base terminal of the PNP type transistor T7 on the power source PS side, a source terminal and a drain terminal of the field-effect transistor F1 are connected thereto, respectively. A gate terminal of the field-effect transistor F1 is connected to the power source PS side.

In the present embodiment, in a normal state without the occurrence of a short circuit between the signal lines, the gate terminal of the field-effect transistor F1 has a power source potential and the field-effect transistor F1 is therefore always in an ON state. Thus, an influence of the field-effect transistor F1 on the drive signal can be minimized.

If the potential of the drive signal is decreased to a ground potential as a result of the generation of a short circuit state between the signal lines, on the other hand, the gate potential of the field-effect transistor F1 is decreased to the ground potential. Consequently, the field-effect transistor F1 is turned OFF. Therefore, in such a short circuit state, current supply to the base terminal of the power source PS side transistor T7 is interrupted. Thus, a charge operation of the transistor T1 is stopped, thereby preventing the generation of an overcurrent.

When the short circuit is eliminated, the potential of the drive signal is restored, thereby turning the field-effect transistor F1 ON again. Thus, a normal current amplification operation can be performed. The magnitude of a current applied to the field-effect transistor F1 can be set to a value obtained by dividing the maximum current value of the drive waveform by the current gain of the power source PS side transistor T7. Thus, a component with a small current rating can be employed. Therefore, the damage of the current amplifier circuit 1054 due to an overcurrent can be prevented from occurring without employing an expensive and large-size component.

In the above-described example, when the potential of the drive signal is decreased to the ground potential, the field-effect transistor F1 is turned OFF. However, such a response operation may be delayed due to an influence of a gate capacitance of the field-effect transistor F1. If the response operation is delayed, timing of the current interruption to the power source PS side transistor T7 is delayed, possibly resulting in the damage thereof. Thus, in the example illustrated in FIG. 6, a circuit having a transistor F2 is connected to the field-effect transistor F1 as a discharge circuit for releasing a charge of the gate capacitance of the field-effect transistor F1 when the potential of the drive signal is decreased to the ground potential. The transistor F2 employs an NPN type transistor. A collector terminal and an emitter terminal thereof are connected to the power source PS side and the ground E side, respectively, and a base terminal thereof is connected to the output side. With the transistor F2 connected in this way, a delay time of the response operation of the field-effect transistor F1 can be reduced by releasing the charge of the gate capacitance when the potential of the drive signal is reduced to the ground potential, thereby improving the responsiveness thereof. Therefore, the damage of the transistor T7 as a result of the delayed response operation of the field-effect transistor F1 can be reliably prevented from occurring.

Moreover, due to the connection of the field-effect transistor F1 to the power source PS side transistor T7, a responsiveness difference may be generated between a circuit (referred to as a charge side circuit) constituted by the transistor T5, the field-effect transistor F1, and the transistor T7 and a circuit (referred to as a discharge side circuit) constituted by the transistor T6 and the transistor T8, possibly resulting in the generation of an oscillation phenomenon and a shoot-through current.

Such a problem can be eliminated by giving an impedance equivalent to that of the field-effect transistor F1 to the discharge side circuit. In the example illustrated in FIG. 6, a resistance element R1 having an impedance equivalent to that of the field-effect transistor F1 is connected between the collector terminal of the transistor T6 in the preceding stage and the base terminal of the transistor T8 in the subsequent stage in the discharge side circuit. By connecting the resistance element R1 in such a manner, the current amplifier circuit 1054 can be normally operated even when the field-effect transistor F1 is connected thereto.

As described above, according to the present embodiment, the current being applied to the current amplifier circuit is interrupted promptly by the protection circuit when the drive signal for driving the ink jet recording head is turned to have the ground potential due to a short circuit of the signal lines or the like. As a result, the damage of the transistor due to an overcurrent can be prevented from occurring.

As a protection circuit, instead of using a protection element such as a fuse incapable of being restored once fusing occurs, a field-effect transistor is used as an element for interrupting a current applied to the current amplifier circuit. The current is interrupted by the switching of the field-effect transistor. Therefore, when the primary factor of the short circuit is removed, the interruption by the field-effect transistor can be removed and the current amplifier circuit can be therefore restored without a replacement of the component or the like.

Moreover, by setting the current interruption position not on the output side after the current amplification or in series with the power source side but between the multi-stage Darlington-connected transistors, a current applied to the current interruption element can be made small. Therefore, a small and inexpensive component having a small current rating can be employed as the current interruption element.

According to the present invention, a current interruption element for protecting a current amplifier circuit from a short circuit of a drive signal can be configured by employing a small and inexpensive circuit component in an ink jet recording device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An ink jet recording device comprising:

an ink jet recording head for discharging an ink droplet; and a recording control part for outputting a drive signal to cause the ink jet recording head to discharge an ink droplet, wherein the recording control part includes a current amplifier circuit for amplifying a drive signal by active elements connected in multi-stages, the current amplifier circuit includes a current interruption element connected to an input side of the active element of the current amplifier circuit on a power source side, the current interruption element being for preventing damage of the active element due to an overcurrent from occurring when a short circuit of the drive signal is generated, the current interruption element is connected to a charge side circuit of the current amplifier circuit, and a resistance element having an impedance equivalent to that of the current interruption element is connected to a discharge side circuit of the current amplifier circuit so as to correspond to the current interruption element.

2. The ink jet recording device according to claim 1, wherein the current interruption element is a field-effect transistor.

3. The ink jet recording device according to claim 2, wherein the current amplifier circuit further comprises:

a discharge circuit connected to the field-effect transistor, to release a gate charge of the field-effect transistor when the short circuit of the drive signal is generated.

4. A short circuit protection method for protecting an ink jet recording device for outputting a drive signal to an ink jet recording head so as to perform a recording operation by discharging an ink droplet from the ink jet recording head, from a short circuit of the drive signal, the method comprising:

when the short circuit of the drive signal is generated in a current amplifier circuit for amplifying the drive signal by active elements connected in multi-stages, interrupting, by means of a combination of (i) a current interruption element connected to a charge side circuit of the current amplifier circuit and connected to an input side of the active element of the current amplifier circuit on a power source side and (ii) a resistance element having an impedance equivalent to that of the current interruption element and being connected to a discharge side circuit of the current amplifier circuit so as to correspond to the current interruption element, a current applied to the active element so as to prevent damage of the active element due to an overcurrent from occurring.

* * * * *